US005839605A

United States Patent [19]

Hadtke et al.

[11] Patent Number: 5,839,605

[45] Date of Patent: Nov. 24, 1998

[54] CUP DISPENSER

[75] Inventors: Frederick Hadtke, New Providence; Jonathan Rush, Phillipsburg, both of N.J.

[73] Assignee: Fort James Corporation, Richmond, Va.

[21] Appl. No.: 609,476

[22] Filed: Mar. 1, 1996

[51] Int. Cl.[6] ..... A47F 1/00

[52] U.S. Cl. ..... 221/59; 221/63; 221/279; 312/43; 312/71

[58] Field of Search ..... 221/56, 58, 59, 221/63, 45, 279; 312/43, 71

[56] References Cited

U.S. PATENT DOCUMENTS

| | | | |
|---|---|---|---|
| 1,062,306 | 3/1913 | Gilbert-Rolfe . | |
| 2,273,644 | 2/1942 | Hope . | |
| 3,203,587 | 8/1965 | Mount et al. . | |
| 3,261,500 | 7/1966 | McGlynn | 221/63 |
| 3,623,636 | 11/1971 | D'Ercoli | 221/63 |
| 4,199,076 | 4/1980 | Brown . | |
| 4,243,153 | 1/1981 | Mitchell | 221/59 |
| 4,840,291 | 6/1989 | Merlin | 221/59 |
| 4,858,783 | 8/1989 | Mayfield | 221/59 |
| 4,951,837 | 8/1990 | Lentsch | 221/63 |

*Primary Examiner*—H. Grant Skaggs
*Attorney, Agent, or Firm*—Sixbey, Friedman, Leedom & Ferguson, PC; Charles M. Leedom, Jr.; Donald R. Studebaker

[57] ABSTRACT

A cup dispenser is disclosed including a housing having an open end and a closed end defining a cup receiving cavity, a cup support reciprocally positioned within the cup receiving cavity for supporting at least one cup received in the cup receiving cavity and a spring for biasing the cup support towards the open end of the cup receiving cavity thereby projecting at least a portion of the cup from the housing. The cup dispenser further includes a guide for guiding the cup support within the housing with a guide including axially extending substantially diametrically opposed rails and a cup restraint for restraining outward movement of the cup within the cavity and a stop position adjacent the guide for stopping outward movement of the cup support. The stop includes at least one circumferentially extending contact surface which contacts a surface of the cup support in order to stop outward movement of the cup support. Additionally, the cup restraint includes at least one substantially radially inwardly extending detent positioned adjacent the open end of the housing as well as an auxiliary cup restraint positioned adjacent the first cup restraint for staging of the next cup to be dispensed. This auxiliary cup restraint prevents dispensing of more than one cup at a time by relieving the pressure of the total stack load and spring pressure on the cup to be dispensed. The auxiliary cup restraint includes at least one axially extending fin with the fin having an axial length which is less that the axial length of the diametrically opposed rails. The fins further include cup stacks stabilizers which stabilizes the stack of cups adjacent the open end of the housing. Further, an annular recess is formed in the housing extending about an outer circumference thereof and adjacent the open end of the housing.

21 Claims, 7 Drawing Sheets

FIG. 1
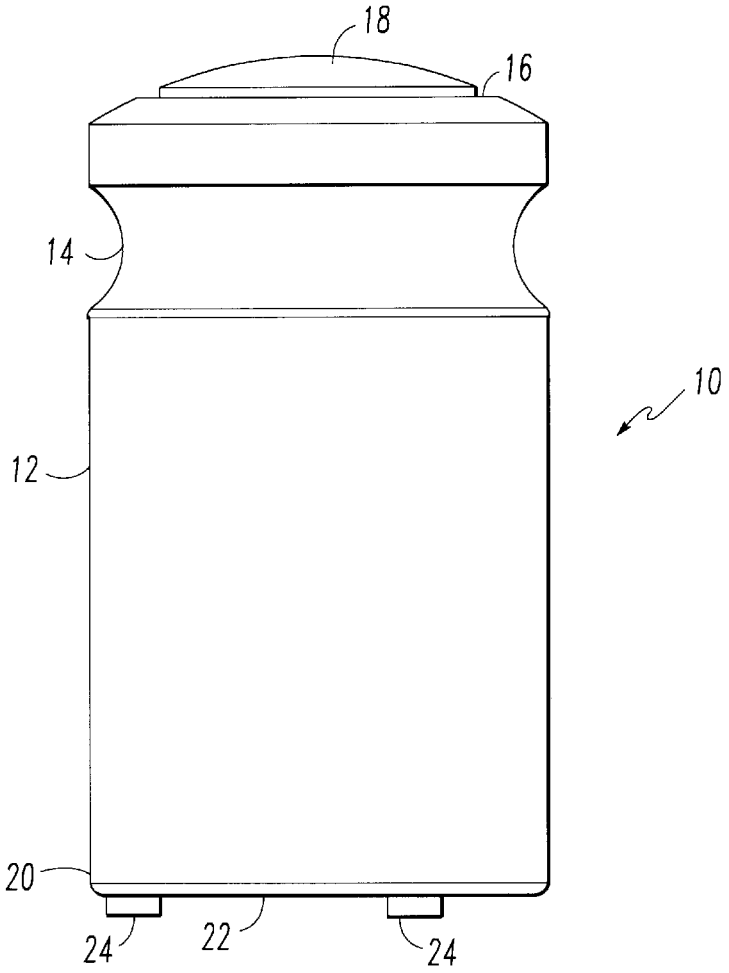
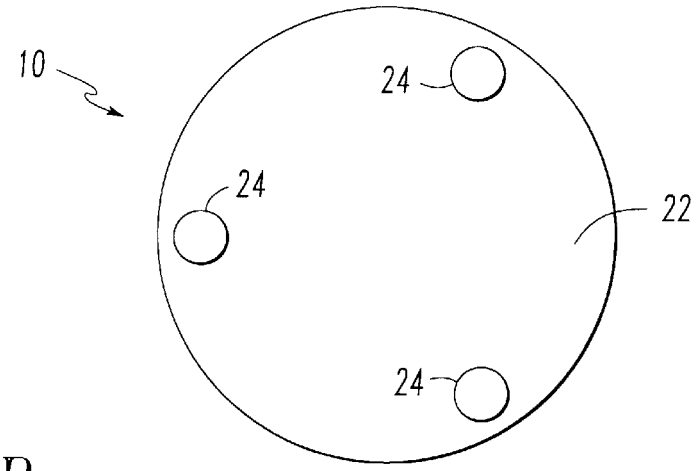
FIG. 2B

FIG.2A
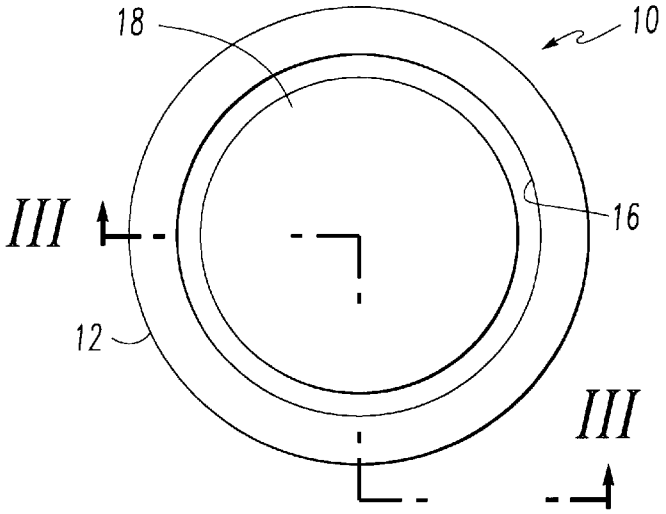
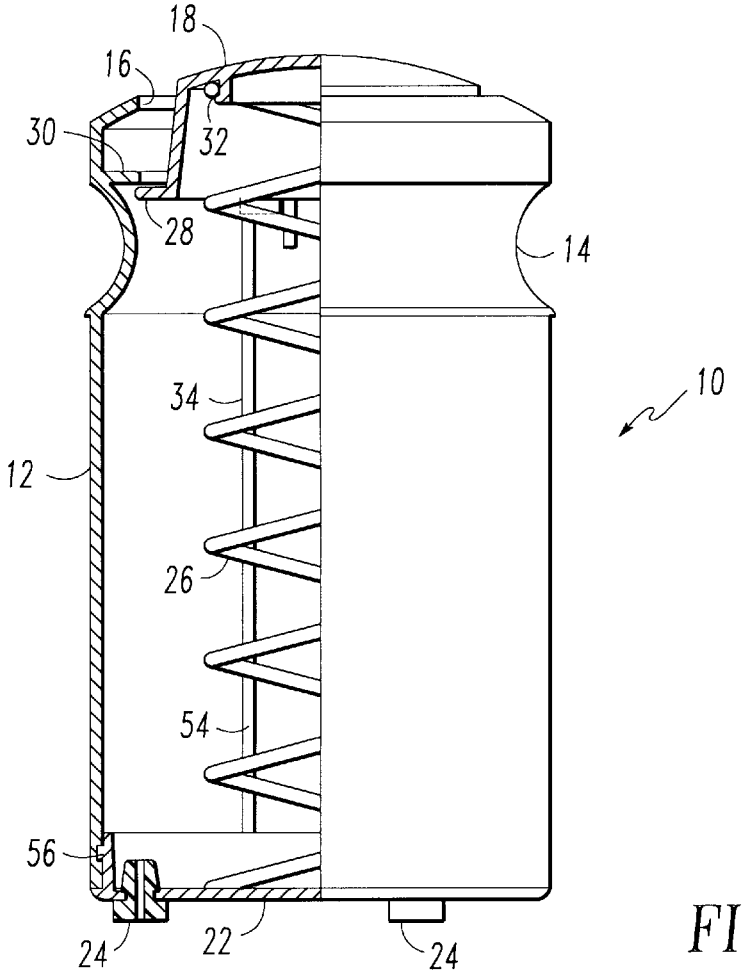
FIG.3

FIG.6
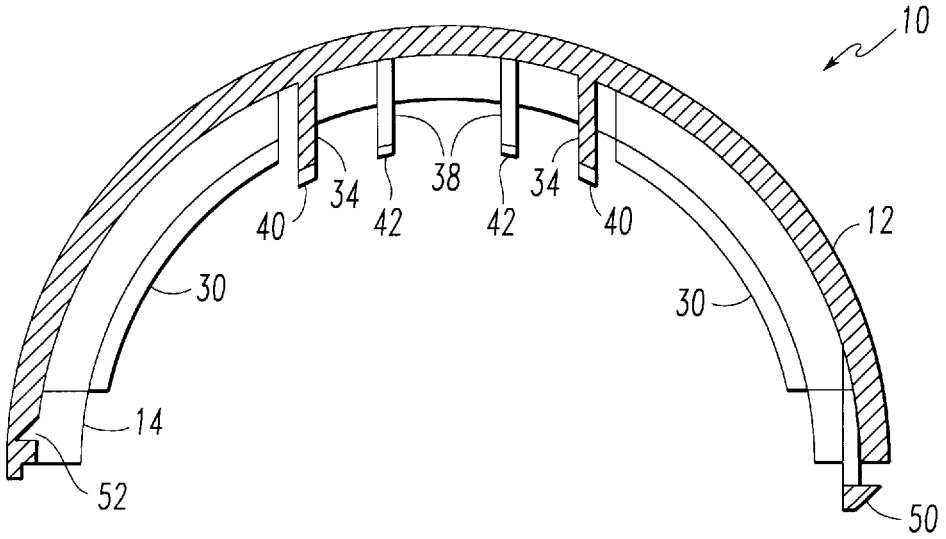
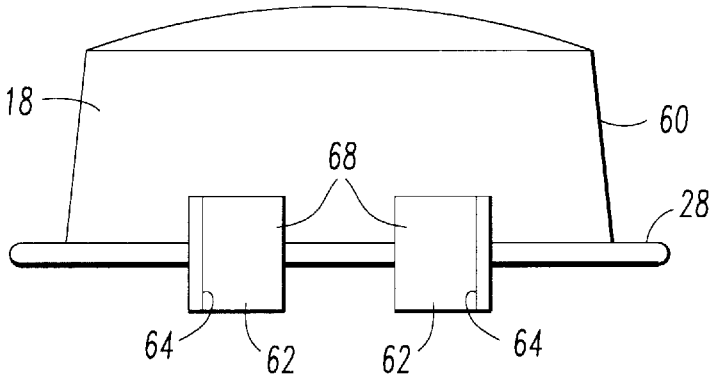
FIG.7

FIG. 8
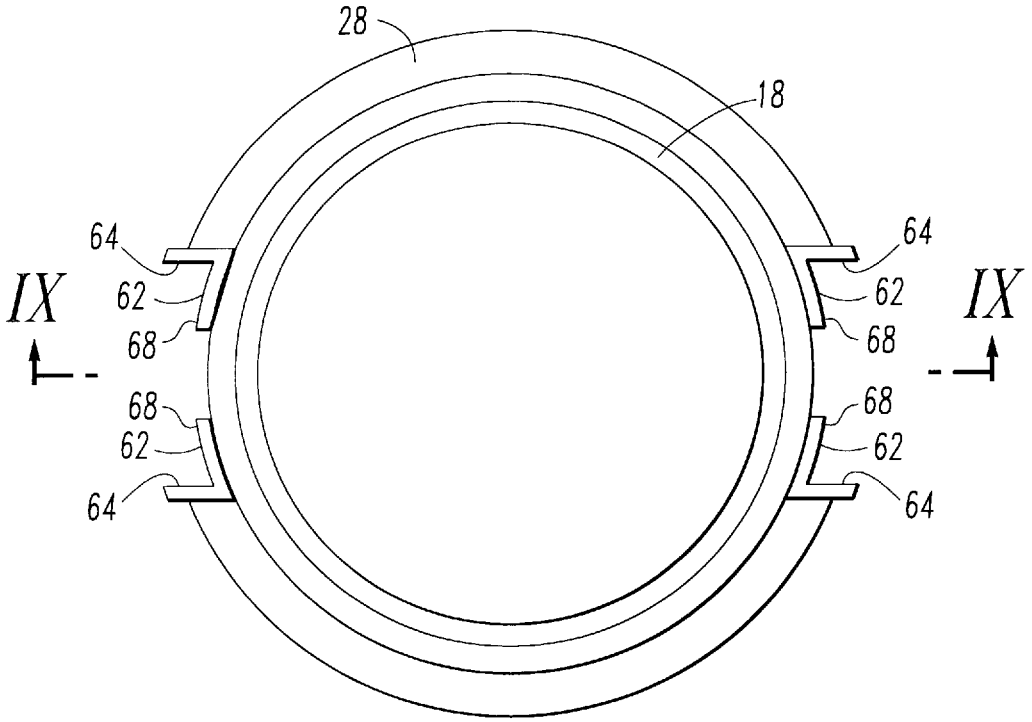
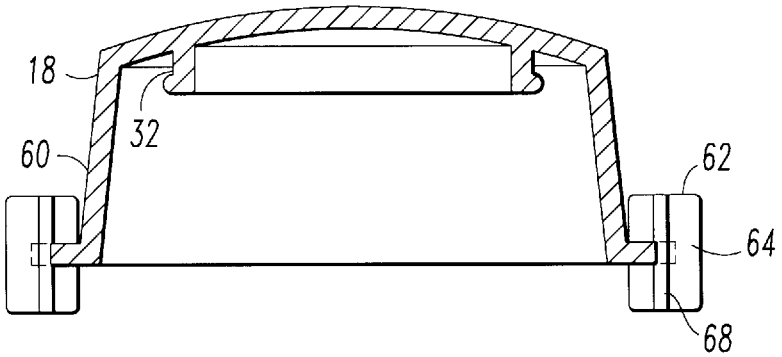
FIG. 9

CUP DISPENSER

TECHNICAL FIELD OF THE INVENTION

The present invention is directed to a dispenser for dispensing cups one at a time and more particularly is directed to a cup dispenser for dispensing individual cups from a stack in a manner which minimizes any deformation of the cup when removed from the dispenser

BACKGROUND OF THE INVENTION

Cup dispensers for receiving a stack of paper cups and subsequently permitting the cups to be dispensed therefrom one at a time are well-known and used in numerous fast food establishments, mini-marts as well as by consumers for home use. Many of these dispensers are arranged to receive a vertical stack of cups with the cup being removed located at the bottom end of the dispenser. Such a dispenser is set forth in U.S. Pat. No. 3,203,587 which includes a substantially cylindrical housing having a biasing means for biasing the stack of cups towards an open end of the cylinder. Adjacent the open end of the cylinder are biasing means which contact a portion of at least the initial cup in the stack and retain the stack within the cylinder until a force is exerted by the consumer to withdraw the lowermost cup from the dispenser. Therein, the biasing means contacts the lowermost cup at four mutually spaced locations about the parameter of the cup. In doing so, when the cup is removed from the dispenser, the cup is necessarily deformed in that the force acting on the cup must be strong enough to stop the next cup in line. Accordingly, the brim of the cup being dispensed is often torn or otherwise deformed resulting in the dispensed cup being discarded and not used.

Similarly, U.S. Pat. No. 2,273,644 issued to Hope discloses a dispenser for dispensing individual cups from a stack including a cylindrical housing and biasing means for biasing the cups toward an open end of the housing. Unlike the previous dispenser, this dispenser includes a restraining means which encompasses an entire periphery of a cup and when a force is exerted by the consumer on the cup, the biasing means expands permitting removal of the cup. Again, when removing such cups from this dispenser, not only is the brim of the cup being dispensed deformed, when the retaining means pivots back into its retaining position, exerts a force on the subsequent cup which can deform the cup before it is dispensed from the cup dispenser.

In an effort to overcome the aforementioned shortcomings, U.S. Pat. No. 4,199,076 issued to Brown discloses a cup dispenser suitable for use in a household for dispensing cups therefrom one at a time. The dispenser includes a main body having a cup cavity including a slidable plate mounted therein for receiving a stack of cups. A helical spring urges the plate toward the cavity opening to allow for the removal of one cup at a time from the dispenser main body. The spring is further permits a new stack of cups to be asserted into the cup cavity. In order to restrain dispensing of the cups from the cavity, a plurality of ribs, specifically four ribs being mutually spaced about the cup are provided with a guide upon which the plate moves to and from the cavity opening. The ribs further include enlarged ends which project into the cavity which contact the plate and prevent movement of the plate through the opening when the lowermost cups are removed from the dispenser. The enlarged ends further press against the brim of sequential cups preventing them from being dispensed from the dispenser until a force is exerted on the uppermost cup by the consumer which is sufficient to deform the uppermost cup enough to pass the enlarged portions of the ribs. As with the above-noted dispensers, this deformation of the brim portion of the cup often times results in tearing or otherwise deforming of the cup's brim to the point where the cup is discarded without being used. Further, the housing and ribs are simultaneously molded in their entirety in a molding operation which requires the ribs to taper inwardly toward the opening in the housing. Consequently, the support plate for supporting the stack of cups within the housing is not uniformly reciprocated within the housing which may result in jamming of the support plate and consequently a failure to urge the stack of cups toward the opening.

Clearly, there is a need for a cup dispenser which dispenses one cup at a time in response to a force being exerted on a leading cup in a stack and which dispenses the cup without unduly deforming either the cup being dispensed or the next subsequent cup in the stack.

SUMMARY OF THE INVENTION

A primary object of the present invention is to overcome the aforementioned shortcomings associated with prior cup dispensers.

It is an object of the present invention to provide a cup dispenser which dispenses an uppermost cup in a stack while minimizing deformation of both the cup being dispensed or the remaining cups housed within the cup dispenser housing.

A further object of the present invention is to provide a cup dispenser which can be readily molded having guides which extend parallel to the central axis of the cup's dispenser so as to guide a stack of cups toward an opening of the cup dispenser in an unrestricted manner.

It is a further object of the present invention to provide a molded cup dispenser which forms a rigid structure when fully assembled.

A more important object of the present invention is to provide a cup dispenser having substantially diametrically opposed guide means and cup restraining means so as to permit the cup being dispensed to flex thereby limiting deformation of the cup when the cup is withdrawn from the cup dispenser.

A further object of the present invention is to provide an auxiliary cup restraint for preventing the dispensing of more than one cup at a time by relieving the pressure of the total stack load and spring pressure on the cup to be dispensed.

Yet another object of the present invention is to provide a support plate which adequately supports a stack with cups within the cup dispenser and a stop for stopping the support plate before the support plate reaches the means for restraining outward movement of the leading cup in the stack so as not to unduly deform the brims of the cups within the stack.

A further object of the present invention is to provide a stop surface within the cup dispenser for stopping a forward movement of the cup stack support plate which is maintained out of contact with the stack of cups themselves.

Yet another object of the present invention is to provide a cup stack support plate within the cup dispenser having slide plates connected thereto which contact and slide along one surface of the axially extending ribs provided within the cup dispenser for restraining rotational movement of the cup support means while permitting unrestricted reciprocal movement within the housing.

Yet another object of the present invention is to provide a cup dispenser which can receive selected closures permitting the cup dispenser to be mounted in a variety of positions.

These as well as additional objects of the present invention are achieved by providing a cup dispenser including a housing having an open end and a closed end defining a cup receiving cavity, a cup support reciprocally positioned within the cup receiving cavity for supporting at least one cup received in the cup receiving cavity and a spring for biasing the cup support towards the open end of the cup receiving cavity thereby projecting at least a portion of the cup from the housing. The cup dispenser further includes a guide for guiding the cup support within the housing with the guide including axially extending substantially diametrically opposed rails and a cup restraint for restraining outward movement of the cup within the cavity and a stop positioned adjacent the guide for stopping outward movement of the cup support. The stop includes at least one circumferentially extending contact surface which contacts a surface of the cup support in order to stop outward movement of the cup support. Additionally, the cup restraint includes at least one substantially radially inwardly extending detent positioned adjacent the open end of the housing as well as an auxiliary cup restraint positioned adjacent the first cup restraint for staging of the next cup to be dispensed. That is, the auxiliary cup restraints prevent the dispensing of more than one cup at a time by relieving the pressure of the total stack load and spring pressure on the cup to be dispensed. The auxiliary cup restraint includes at least one axially extending fin with the fin having an axial length which is less that the axial length of the diametrically opposed rails. The fins further include cup stack stabilizers which stabilizes the stack of cups adjacent the open end of the housing. Further, an annular recess is formed in the housing extending about an outer circumference thereof and adjacent the open end of the housing. This annular recess rigidifies the overall construction of the housing thus permitting the housing to be mounted in various positions.

These as well as additional objects of the present invention will become apparent from the following detailed description of the present invention when read in light of the several figures.

BRIEF DESCRIPTION OF THE DRAWINGS

FIG. 1 is a side elevational view of the cup dispenser in accordance with the present invention;

FIG. 2A is a top view of the cup dispenser of FIG. 1;

FIG. 2B is a bottom view of the cup dispenser of FIG. 1;

FIG. 3 is a partial cross view of the cup dispenser of FIGS. 1 and 2 taken along line III—III of FIG. 2A;

FIG. 6 is a cross sectional view of the housing taken along line VI—VI of FIG. 4;

FIG. 7 is a side elevational view of the cup support plate illustrated in FIG. 3;

FIG. 8 is a top view of the cup support plate of FIG. 7;

FIG. 9 is a cross sectional view of the cup support plate taken along line IX—IX of FIG. 8;

DETAILED DESCRIPTION OF THE PRESENT INVENTION

Figure 4:
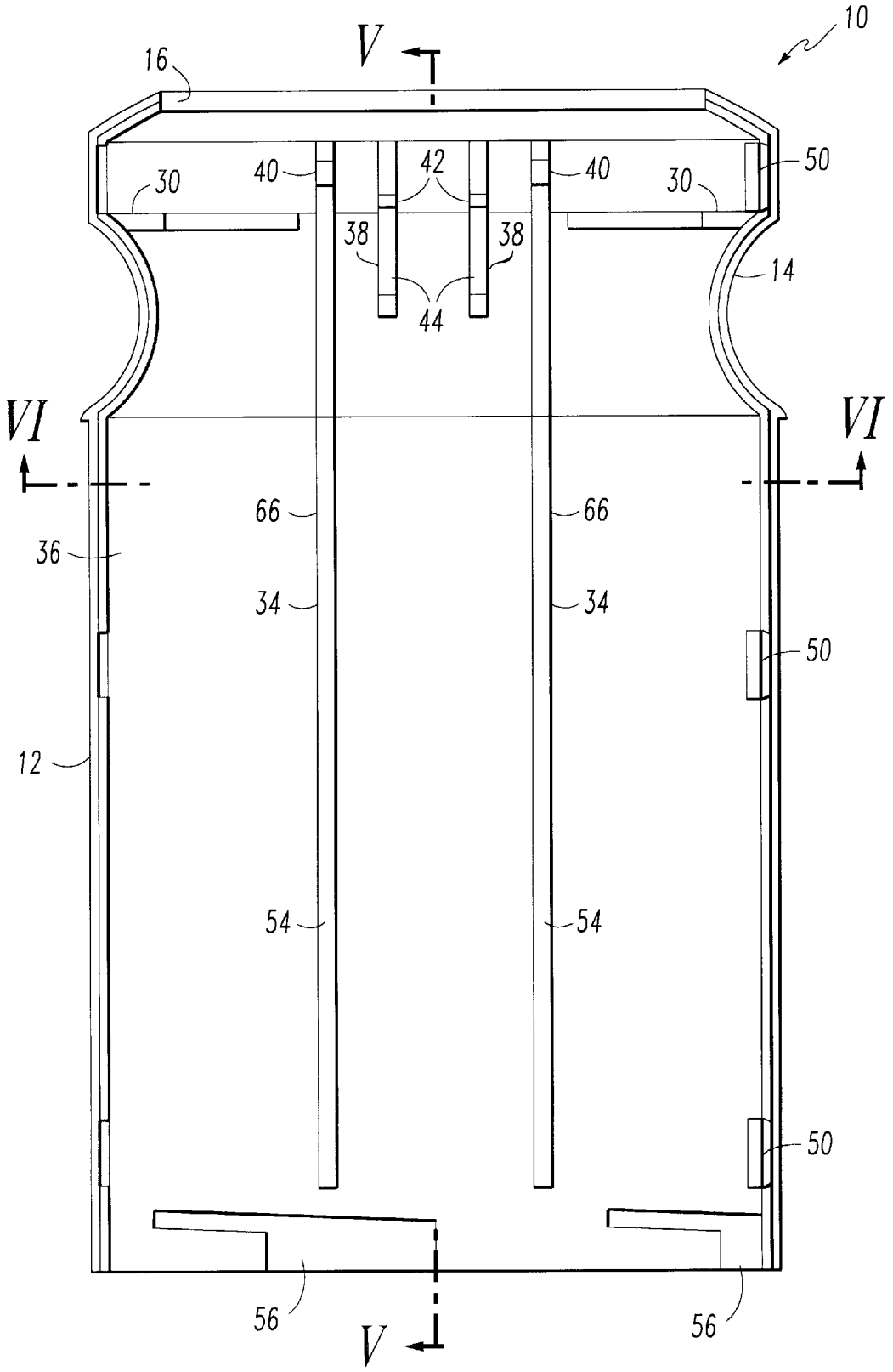
FIG. 4 is an elevational interior view of the housing forming the cup dispenser of FIG. 1.

Referring now to the several figures, the cup dispenser formed in accordance with the present invention will now be described in greater detail hereinbelow.

Referring particularly to FIGS. 1A and 2B, the cup dispenser 10 includes an outer housing 12, preferably formed of plastic which may be readily injection molded or otherwise molded into the configuration illustrated herein. Housing 12 is substantially cylindrical and includes an annular recess 14 formed about an upper end of the housing. This upper end of the housing in the embodiment illustrated in FIG. 1 includes an opening 16 which permits the ingress and egress of cups from the cup dispenser 10. When no cups are positioned within the dispenser 10, the cup support plate 18 is permitted to extend from the housing 12 through opening 16 and is visible in both the top view and side elevational views of the dispenser. While the housing 12 includes opening 16, a second end of the housing 20 is closed and sealed by way of bottom plate 22 which in the embodiment illustrated in FIG. 1 includes feet 24 formed of a resilient material for positioning the dispenser 10 on a substantially horizontal surface. The bottom 22 and feet 24 being readily illustrated in the bottom view shown in FIG. 2B. As will be discussed in greater detail hereinbelow, the bottom plate 22 is interchangeable with a support plate which enables the dispenser 10 to be mounted in a variety of positions. Accordingly, the bottom plate 22 is illustrated only by way of example and may take on a number of configurations.

Referring now to FIG. 3, the cup dispenser 10 is illustrated in a partial cross-sectional view which shows the interior mechanics of the cup dispenser as they relate to the outer surface thereof.

Positioned within the housing 12 is a biasing means in the form of a compression spring 26 which biases the support plate 18 towards the opening 16 formed in the housing 12. As will be discussed in greater detail hereinbelow, the support plate includes a flange 28 which contacts the circumferentially extending contact surface 30 which restricts outward movement of the support plate 18 with respect to the housing 12. Also provided within an underside of the support plate is a recess 32 for receiving the spring 26 and maintaining the radial position of the spring with respect to the support plate 18. Likewise, the bottom plate 22 may include a means for maintaining the radial positioning of the spring 26.

Figure 5:
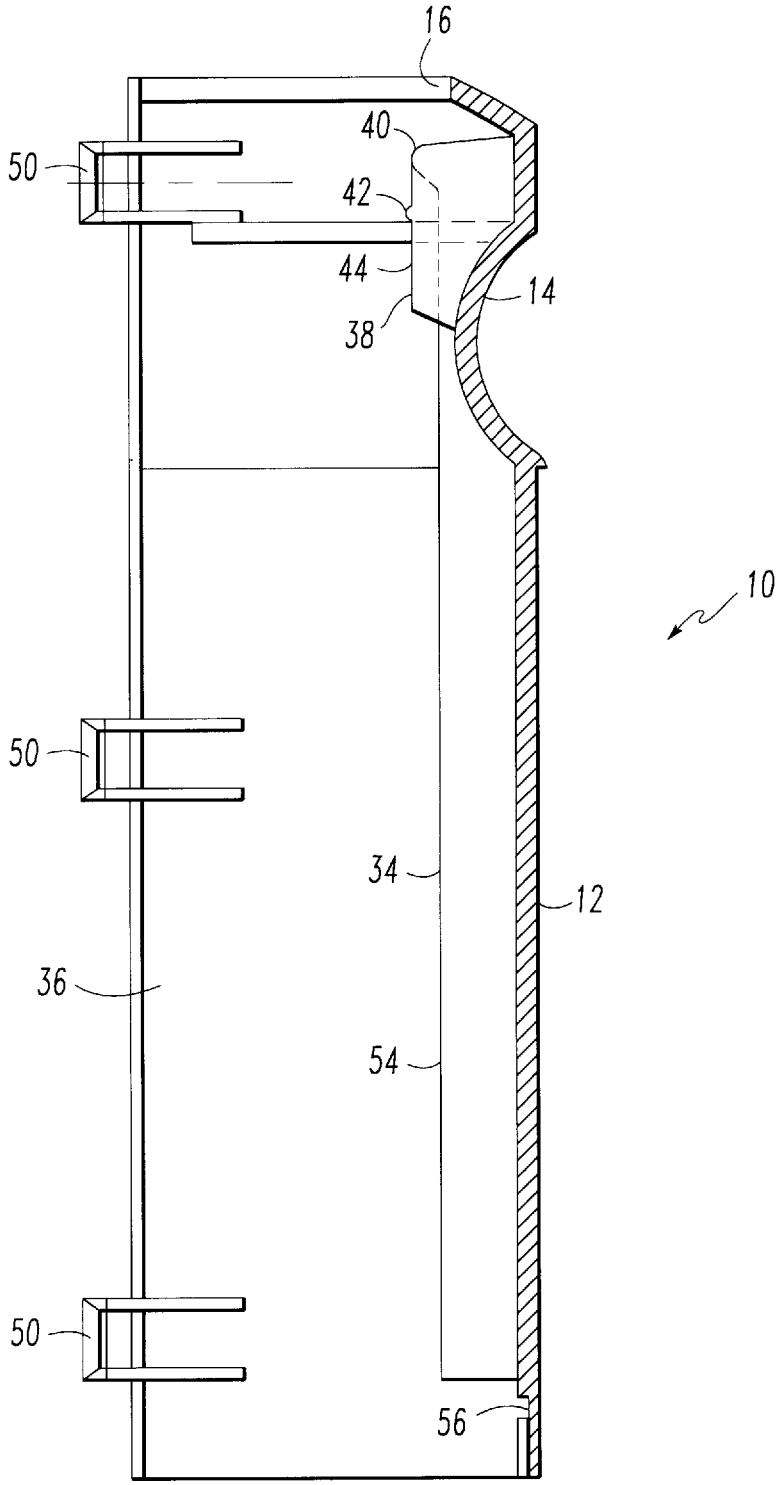
FIG. 5 is a cross sectional view of the housing taken along line V—V of FIG. 4.

Within the housing 12 are positioned a plurality of axially extending rails 34 which are best illustrated in FIGS. 4 and 5. As can be seen from FIG. 4, the rails 34 are spaced from one another and extend toward an opposing side of the housing 12. The rails 34 do not extend radially towards a central axis of the cup dispenser 10 but extend away from the inner sidewall 36 of the housing 12 substantially parallel to one another thus extending along a chord of the cylindrical housing 12. Also provided within the housing 12 are fins 38 which likewise extend from the inner wall 36 of the housing 12 substantially parallel to one another and thus substantially parallel to the rails 34 as well. As is best seen from FIG. 5, the rails 34 include detents or restraints 40 which extend from an upper limit of the rail 34 for contacting a surface of the cup being dispensed from the dispenser. Likewise, the fins 38 include detents or auxiliary restraints 42 which also contact a surface of the cups being dispensed from the dispenser 10. Further, the body of the fins 38 has a greater extent than that of the rails 34 and extend further into the housing 12 thus providing a stabilizing portion 44 which stabilizes a stack of cups within the housing adjacent the opening 16. In doing so, the stack of cups will neatly and uniformly extend from the housing 12. Additionally, the detents 42 are spaced from detents 40 so as to prevent dispensing of more than one cup at a time from the housing 12 by relieving the pressure of the total stack load and spring pressure on the cup to be dispensed.

As can be appreciated from FIGS. 4 and 5, the contact surface 30 extends about the circumference of the inner wall 36 with the exception of the regions where the rails 34 and fins 38 are provided. By providing a substantial contact surface, the support plate 18 is uniformly stopped and positioned at the opening 16 of the housing. Additionally, the detents 40 and 42 extending from both the rails 34 and fins 38 are positioned closer to the central axis of the housing than is the inner edge of the contact surface 30 such that it is not possible to pinch the brim of a cup between the contact surface 30 and the flange 28 of the support plate 18 so as to minimize any deformation to the brim of a cup being removed from the dispenser 10.

The housing 12 is readily injection molded in the form the two halves which are substantially mirror images of one another. As can be seen from FIGS. 5 and 6, each half of the housing includes locking clips 50 which are readily received within recesses 52 formed in the other half of the housing. Thus, the housing, after being injection molded can be "snapped" together thus forming a substantially cylindrical structure. Because the housing 12 is molded from two or more substantially identical components, the rails 34 are permitted to be molded such that the inner surface 54 of the rails is substantially parallel to a central access of the housing 12 rather than being required to taper inwardly from one end of the housing to the other to permit the molded housing to be readily removed from the mold. The significance of this feature will be described in greater detail hereinbelow. Additionally, molded into the inner wall 36 of the housing 12 are recesses 56 which are provided to receive and secure the bottom plate 22 or other closing for this end of the housing 12.

Again, referring to FIG. 6, the extent of the rails 34 and fins 38 which extend substantially parallel to one another is readily illustrated. Further, the radial extent of the contact surfaces 30 which is less than that of the radial extent of the detents formed on rails 34 and fins 38 becomes readily apparent.

Referring now to FIGS. 7–9, the support plate 18 and its positioning and movement within the housing 12 will now be described in greater detail. As is readily apparent from FIG. 7, the support plate 18 includes the flange 28 which extends about a periphery, of a cup positioning dome 60 which receives a portion of the lowermost cup of the stack in order to centrally locate the stack on the support plate 18. Secured to the flange 28 are slides 62 including slide surfaces 64 which cooperate with outer surfaces 66 of the rails 34 for permitting reciprocal movement of the support plate 18 within the housing 12 while maintaining the radial position of the support plate therein. As discussed hereinabove, because the housing 12 is formed of at least two components, the inner surfaces 54 of the rails 34 extend parallel to the central axis of the housing and thus readily cooperate with the axially extending slide surfaces 68 of the slide 62, thus preventing the slide plate 18 from jamming within the housing 12.

As is readily apparent from FIGS. 7 and 8, the slide surfaces 64 which contact the surfaces 66 of the rails 34 extend substantially parallel to one another and along what is considered a chord of the housing 12. With reference to FIG. 9, the recess 32 referred to hereinabove with respect to FIG. 3 is readily illustrated with this recess cooperating with the compression spring 26 for receiving an upper turn of the compression spring 26 in order to maintain the positioning of the compression spring within the housing 12. It is noted that this recess 32 may take on any configuration and be formed in any manner so long as the spring 26 is stabilized with respect to the slide plate 18.

As is readily apparent from the foregoing discussion, a cup dispenser 10 is provided wherein cups can be readily removed from the housing while minimizing deformation to the cups and particularly the brims of such cups. As can be appreciated from the foregoing discussion, when a cup is removed from or withdrawn through the opening 16 formed in the housing 12, the cup is permitted to flex outwardly, that is, take on somewhat of an oblong shape so as to permit the brim of an uppermost cup to bypass the detents 40 and 42 and thus allow the cup to be removed from the dispenser without unduly deforming the brim curl. With prior art dispensers which contacts the cup at least four mutually spaced contact points about a periphery of the cup, the cup was not permitted to take on an oblong shape and any force exerted on the cup is countered by a compression of the brim at at least those four contact points. In doing so, many cups removed from the dispenser are deformed and some deformed to the extend where the cup is not useable. Clearly, the present invention eliminates such a problem.

Figure 11:
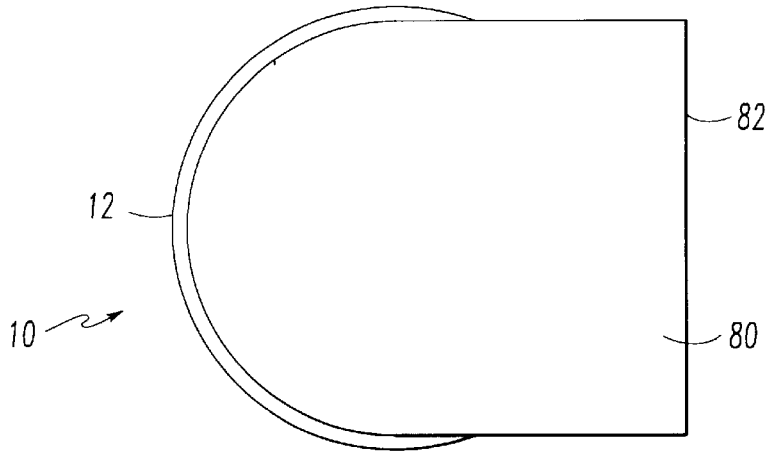
FIG. 11 is a top view of the cup dispenser of FIG. 10.
Figure 10:
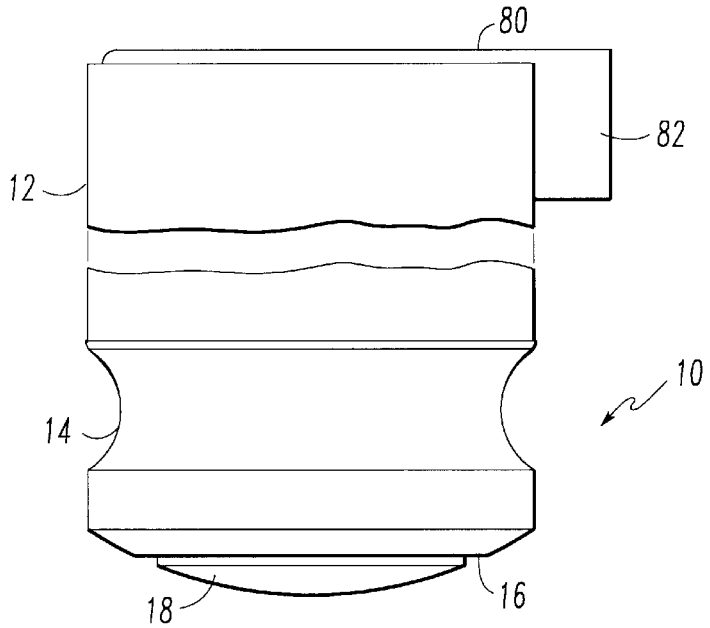
FIG. 10 is a side elevational view of a cup dispenser in accordance with an alternative embodiment of the present invention.
Figure 12:
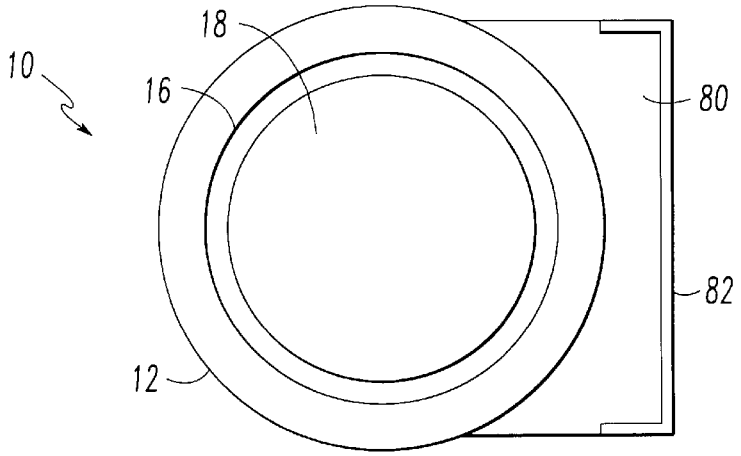
FIG. 12 is a bottom view of the cup dispenser of FIG. 10.

Referring now to FIGS. 10–12, as discussed hereinabove, the bottom plate 22 may be replaced by plate 80 which connects to the housing 12 in a manner identical to that of the bottom plate 22. This plate 80 may include a substantially planer surface which in use forms a top surface of the dispenser 10 with a mounting bracket 82 connected thereto. This permits the dispenser 10 to be mounted on non-horizontal surfaces for the convenience of the user. It should be noted, however, with the cup dispenser 10 mounted in the position illustrated in FIG. 10, the detents 40 and 42 must exert a force on the brim of the cup strong enough to counteract the forces of gravity acting on the support plate 18 as well as the cups themselves. However, with the construction of the present cup dispenser, the cups are still permitted to expand in the manner discussed hereinabove, thus limiting any deformation to the cups being withdrawn from the dispenser 10.

Accordingly, by constructing a cup dispenser in accordance with the foregoing, a cup dispenser which dispenses one cup at a time in response to a force being exerted by the consumer on the leading cup in a stack and which dispenses a cup without unduly deforming either the cup being dispensed or the next subsequent cup in the stack is achieved. Further, a cup dispenser which can be readily molded using conventional molding processes is formed in a manner such that the support plate can freely reciprocate within the housing.

While the present invention has been described with reference to a preferred embodiment, it will be appreciated by those skilled in the art that the invention may be practiced otherwise than as specifically described herein without departing from the spirit and scope of the invention. It is, therefore, to be understood that the spirit and scope of the invention be limited only by the appended claims.

We claim:

1. A cup dispenser comprising;

a housing having an open end and a closed end defining a cup receiving cavity;

a cup support means reciprocally positioned in said cup receiving cavity for supporting at least one cup received in said cup receiving cavity;

biasing means for biasing said cup support means towards said open end;

guide means for guiding said cup support means within said housing, said guide means including axially extending substantially diametrically opposed rails and a cup restraining means for restraining outward movement of said at least one cup; and stopping means positioned adjacent said guide means and spaced inward from said cup restraining means for stopping outward movement of said cup support means.

2. The cup dispenser as defined in claim 1, wherein said stopping means includes at least one circumferentially extending contact surface for contacting a surface of said cup support means.

3. The cup dispenser as defined in claim 1, wherein said substantially diametrically opposed rails include pairs of circumferentially spaced rails.

4. The cup dispenser as defined in claim 3 wherein said cup restraining means includes at least one substantially radially inwardly extending detent positioned adjacent said open end of said housing.

5. The cup dispenser as defined in claim 4, wherein said cup restraining means further comprising an auxiliary cup restraining means positioned adjacent said cup restraining means.

6. A cup dispenser comprising;

a housing having an open end and a closed end defining a cup receiving cavity;

a cup support means reciprocally positioned in said cup receiving cavity for supporting at least one cup received in said cup receiving cavity;

biasing means for biasing said cup support means towards said open end;

guide means for guiding said cup support means within said housing, said guide means including axially extending substantially diametrically opposed pairs of circumferentially spaced rails and a cup restraining means for restraining outward movement of said at least one cup; and stopping means positioned adjacent said guide means for stopping outward movement of said cup support means;

wherein said cup restraining means includes at least one substantially radially inwardly extending detent positioned adjacent said open end of said housing and an auxiliary cup restraining means positioned adjacent said cup restraining means, said auxiliary cup restraining means being positioned between each rail of said pairs of circumferentially spaced rails.

7. The cup dispenser as defined in claim 6, wherein said auxiliary cup restraining means includes at least one substantially radially extending detent positioned adjacent said open end of said housing.

8. The cup dispenser as defined in claim 7, wherein said substantially radially extending detent of said auxiliary cup restraining means is axially positioned between said circumferentially extending surface and said substantially radially extending detents of said guide means.

9. The cup dispenser as defined in claim 7, wherein a radial extent of said substantially radially extending detents of said auxiliary cup restraining means is substantially equal to a radial extent of said substantially radially extending detent of said guide means.

10. The cup dispenser as defined in claim 9, wherein a radial extent of said contact surface is less than a radial extent of said detents.

11. The cup dispenser as defined in claim 6, wherein said auxiliary cup restraining means includes at least one axially extending fin, said fin having an axial length less than an axial length of said rails.

12. The cup dispenser as defined in claim 11, wherein said fin further includes a cup stack stabilizing means for stabilizing a stack of cups adjacent said open end of said housing.

13. The cup dispenser as defined in claim 11, wherein said auxiliary cup restraining means includes two substantially diametrically opposed pairs of fins.

14. The cup dispenser as defined in claim 13, wherein said substantially diametrically opposed pairs of fins are positioned between the rails of respective pairs of the substantially diametrically opposing pairs of rails.

15. The cup dispenser as defined in claim 6, wherein said housing includes a first housing component and a second housing component, said components cooperating with one another to form said housing.

16. The cup dispenser as defined in claim 6, wherein said cup support means includes slide means cooperating with said rails for restraining rotational movement of said cup support means and permitting reciprocal movement of said cup support means.

17. The cup dispenser as defined in claim 16, wherein said slide means includes diametrically opposed pairs of slide plates, each plate of a pair of said slide plates contacting a surface of a respective one of said rails.

18. The cup dispenser as defined in claim 6, further comprising rigidifying means for rigidifying said housing.

19. The cup dispenser as defined in claim 18, wherein said rigidifying means includes an annular recess formed in said housing extending about an outer circumference of said housing.

20. The cup dispenser as defined in claim 6, further comprising a mounting means for mounting said housing on a non-horizontal surface.

21. The cup dispenser as defined in claim 20, wherein said mounting means includes a mounting bracket secured to said housing adjacent said closed end such that said housing can be mounted with said open end facing downward.

* * * * *